US010094517B2

(12) United States Patent
Xiang

(10) Patent No.: US 10,094,517 B2
(45) Date of Patent: Oct. 9, 2018

(54) LED IMITATION FILAMENT BULB

(71) Applicant: ZHEJIANG DINGXING ARTS & CRAFTS CO., LTD., Linhai (CN)

(72) Inventor: Chen Xiang, Linhai (CN)

(73) Assignee: ZHEJIANG DINGXING ARTS & CRAFTS CO., LTD., Linhai (CN)

( * ) Notice: Subject to any disclaimer, the term of this patent is extended or adjusted under 35 U.S.C. 154(b) by 39 days.

(21) Appl. No.: 15/251,734

(22) Filed: Aug. 30, 2016

(65) Prior Publication Data

US 2017/0205031 A1 Jul. 20, 2017

(30) Foreign Application Priority Data

Jan. 19, 2016 (CN) ..... 2016 1 0035302

(51) Int. Cl.

| | |
|---|---|
| ***F21V 3/00*** | (2015.01) |
| ***F21K 9/237*** | (2016.01) |
| ***F21K 9/232*** | (2016.01) |
| ***F21K 9/235*** | (2016.01) |
| ***F21V 23/06*** | (2006.01) |
| *F21Y 115/10* | (2016.01) |

(52) U.S. Cl.

CPC ..... *F21K 9/237* (2016.08); *F21K 9/232* (2016.08); *F21K 9/235* (2016.08); *F21V 3/00* (2013.01); *F21V 23/06* (2013.01); *F21Y 2115/10* (2016.08)

(58) Field of Classification Search

CPC ..... F21K 9/237; F21K 9/232; F21K 9/235; F21V 3/00; F21V 23/001; F21V 23/06

USPC ..... 362/311.02

See application file for complete search history.

(56) References Cited

U.S. PATENT DOCUMENTS

| | | | | |
|---|---|---|---|---|
| 8,702,257 | B2 * | 4/2014 | Lenk | F21V 3/00 362/293 |
| 2013/0194797 | A1 * | 8/2013 | Jackson | F21K 9/232 362/236 |
| 2013/0265796 | A1 * | 10/2013 | Kwisthout | F21K 9/232 362/555 |

FOREIGN PATENT DOCUMENTS

| | | |
|---|---|---|
| CN | 204611399 | 9/2015 |

* cited by examiner

*Primary Examiner* — Anh Mai
*Assistant Examiner* — Meghan Ulanday
(74) *Attorney, Agent, or Firm* — Hamre, Schumann, Mueller & Larson, P.C.

(57) ABSTRACT

The invention disclosures an LED imitation filament bulb which belongs to the field of lighting appliance technologies, it solves the problem that LED imitation filament bulb produces the poor line pattern, the LED imitation filament bulb, including a glass shell, a lamp holder fixedly connected to the glass shell, and a LED lamp bead connected within the glass shell, where the LED lamp bead is electrically connected to the lamp holder; at least one imitation filament connected to the lamp holder is disposed within the glass shell; the imitation filament is transparent; the imitation filament is disposed in a bent manner; and a luminous surface of the LED lamp bead faces an end surface of the imitation filament. the LED imitation filament bulb has a luminescence effect of a traditional filament bulb; and the imitation filament bulb is more energy-saving compared with a traditional filament bulb.

6 Claims, 8 Drawing Sheets

LED IMITATION FILAMENT BULB

BACKGROUND

Technical Field

The present invention belongs to the field of lighting appliance technologies and relates to an LED imitation filament bulb.

Related Art

Because of a low luminescence efficiency, incandescent lamps are gradually replaced by energy-saving optical power sources, and in particular, by LEDs. However, as regards some lamps mainly for decorative use, people sometimes hope to present some vintage styles. As a result, a large quantity of incandescent lamp bulbs are still used.

In order that vintage and energy-saving features are both achieved, some LED bulbs imitating incandescent lamps currently appear; some of the bulbs of this sort manufacture LEDs to be strips, and bending shapes of filaments are imitation and are mounted in the bulbs; some use a transparent plastic board as a light guide body, many small bubbles of which shapes are similar to those of the bending shapes are ablated with laser therein, the LEDs are mounted in lamp bases and irradiate to a transparent plastic board; because of diffuse emission of light rays on bubbles, an effect similar to that of an incandescent lamp bulb is presented, but a simulation effect of the LED bulbs imitating incandescent lamps are relatively poor.

In addition, a Chinese utility model patent application (Application No.: 201520106314.X) discloses a new energy-saving decorative lamp, consisting of a bulb and a lamp holder, where the bulb and the lamp holder are fixedly connected to form a hollow integrity; a PCB board is fixedly connected in the lamp holder; a LED lamp body is electrically connected to the PCB board; a lamp post is fixedly connected to the PCB board below the LED lamp body; a line pattern is carved on the lamp post; however, the lamp post of the decorative lamp uses two transparent boards of relatively poor structures; after light enters the transparent boards, it causes that two transparent boards both have a luminescence effect, a whole luminophor is relatively big, and as a result, a filament effect produced on the two transparent boards by using the line pattern is relatively poor.

SUMMARY

An objective of the present invention is providing an LED imitation filament bulb specific to the foregoing problem existing in the prior art; the LED imitation filament bulb has a luminescence effect of a traditional filament bulb and is more energy-saving compared with a traditional filament bulb.

The objective of the present invention may be implemented by the following technical solutions: an LED imitation filament bulb, including a glass shell, a lamp holder fixedly connected to the glass shell, and a LED lamp bead connected within the glass shell, where the LED lamp bead is electrically connected to the lamp holder; at least one imitation filament connected to the lamp holder is disposed within the glass shell; the imitation filament is transparent; the imitation filament is disposed in a bent manner; and a luminous surface of the LED lamp bead faces an end surface of the imitation filament.

The lamp holder is used to be connected on the lamp base, and the lamp holder and the lamp base implement electric connection; the lamp holder transmits electricity to the LED lamp bead connected to the lamp holder; the LED lamp bead emits light; as the name suggests, the imitation filament imitates a filament shape of a traditional filament bulb, can be bent, spiral, and the like, and presents a bent state as a whole; because the LED lamp bead is opposite to the end surface of the imitation filament, light rays emitted by the LED lamp bead can enter the imitation filament and be transmitted within the imitation filament, so that the whole imitation filament is filled with optical paths; therefore, the LED imitation filament bulb has a luminescence effect of a traditional filament bulb; however, because an optical source uses the LED lamp bead, the imitation filament bulb is more energy-saving and efficient compared with a traditional filament bulb.

In the forgoing LED imitation filament bulb, an outer side surface of the imitation filament is provided with at least one rough surface, the rough surface is strip shaped, and the rough surface faces an outer side of the glass shell. When encountering the rough surface, the optical paths in the imitation filament can be diffused, so that the whole rough surface has a light strip effect, which is similar to an effect produced by the filament in the traditional filament bulb; the strip-shaped rough surface more has a lamp strip effect; two ends of the rough surface respectively extend to two ends of the imitation filament, and the rough surface faces the outer side of the glass shell, so that the rough surface produces a continuous and uninterruptible luminescence effect, which is closer to the luminescence effect produced by the continuous and uninterruptible filament.

In the foregoing LED imitation filament bulb, a lampshade is fixedly connected on the lamp holder, the LED lamp bead and the imitation filament are both fixedly connected on the lampshade, and the imitation filament is located at a middle portion of the glass shell. As a carrier of the LED lamp bead and the imitation filament, the lampshade is close to the lamp holder and is located between the lamp holder and the imitation filament, so that the imitation filament is located at the middle position of the glass shell, which more accords with the position of a filament in a traditional filament bulb.

In the foregoing LED imitation filament bulb, the imitation filaments are several, each of the imitation filaments is bent and is V-shaped, two ends of each of the imitation filaments are fixedly connected to the lampshade, and the several imitation filaments are arranged circumferentially. In a traditional filament bulb that is used relatively widely, a filament is wave shaped and surrounds a circle; however, the imitation filaments are several and are arranged circumferentially, and end portions of two adjacent imitation filaments are close to each other, so that the several imitation filaments have their heads and tails close to each other and present an effect of a wave shape surrounding a circle as a whole, and the effect is closer to the luminescence effect of the traditional filament bulb.

In the foregoing LED imitation filament bulb, the lampshade is disciform; one side surface of the lampshade is provided with a mounting cavity; the LED lamp bead is circumferentially connected within the mounting cavity; an end portion of the imitation filament extends into the mounting cavity, and end surfaces, close to each other, of two adjacent imitation filaments are opposite to the same LED lamp bead. The mounting cavity faces the lamp holder; several groups of slots are provided circumferentially on an end surface of the lampshade; each group of slots has two slots close to one another; one end of either of two adjacent imitation filaments is plugged and secured to slots within the same group; the number of LED lamp beads is the same as the number of the imitation filaments, that is, end surfaces of two imitation filaments plugged into the same group of slots are opposite to the same LED lamp bead, so that several imitation filaments have the same luminescence effect, and the number of the LED lamp beads is reduced, making more energy-saving.

In the foregoing LED imitation filament bulb, the lampshade is provided with several connection portions that are circumferentially uniformly arranged; an LED lamp bead is connected on each connection portion; the ends, close to each other, of two adjacent imitation filaments are both fixedly connected on the same connection portion, and the end surfaces are opposite to the LED lamp beads. The lampshade is used to be connected to the imitation filament; therefore, a connection portion used to mount the LED lamp beads and be connected to the imitation filament is provided; the number of the connection portions is the same as the number of the LED lamp beads and the number of the imitation filaments; two slots close to one another are also disposed on the connection portion; one end of either of two adjacent imitation filaments is plugged into two slots of the same connection portion, and is opposite to the LED lamp beads on the connection portion.

In the foregoing LED imitation filament bulb, the number of the imitation filaments is one, and the imitation filament is helical; two ends of the imitation filament are both fixedly connected on the lampshade; the lampshade is disciform; one side surface of the lampshade is provided with a mounting cavity; the number of the LED lamp beads is two, and the LED lamp beads are fixedly connected within the mounting cavity; two end portions of the imitation filament both extend into the mounting cavity, and two end surfaces of the imitation filament are respectively opposite to the two LED lamp beads. The helical imitation filament makes the rough surface be helical, that is, a luminescence effect similar to a helical filament is produced.

In the foregoing LED imitation filament bulb, a lamp post is fixedly connected on the lamp holder; the imitation filaments are several, and two ends of each of the several imitation filaments are both bent in an arc shape and are fixedly connected to an outer side wall of the lamp post; the several imitation filaments are circumferentially arranged; the LED lamp beads are several, and the LED lamp beads are fixedly connected on the lamp post; and one end surface of each imitation filament is opposite to one LED lamp bead. The lamp post is used as a carrier of the LED lamp bead and the imitation filament, and two end surfaces of the same imitation filament are both opposite to one LED lamp bead, so that several imitation filaments present a luminescence effect of a traditional filament bulb.

In the foregoing LED imitation filament bulb, a cross section of the imitation filament is strip-shaped, and the rough surface is one side surface of the imitation filament. A processing mode of the imitation filament uses a transparent plastic board, forms a imitation filament by cutting the plastic board, the cut imitation filament being flat, and then produces a required imitation filament shape by bending.

In the foregoing LED imitation filament bulb, a cross section of the imitation filament is circular, and the rough surface is located on an outer periphery of the imitation filament. Injection molding is performed directly by plastics according to a required imitation filament shape, and processing such as grinding or scratching is performed on a side surface of the imitation filament subjected to injection molding to produce the rough surface.

Compared with the prior art, the LED imitation filament bulb has the following advantages:

1. Because the imitation filament is provided with a rough surface, and the LED lamp bead is opposite to the end surface of the imitation filament, light rays emitted by the LED lamp bead can enter the imitation filament and be transmitted within the imitation filament; when encountering the rough surface, the optical paths can be diffused, which is similar to an effect produced by a filament in a traditional filament bulb. Therefore, the LED imitation filament bulb has a luminescence effect of a traditional filament bulb.

2. Because a light source uses the LED lamp bead and is opposite to the end surface of the imitation filament via the LED lamp bead; therefore, compared with a traditional filament bulb, the imitation filament bulb is more energy-saving and efficient, and light rays are transmitted more uniformly within the imitation filament.

3. Because the rough surface is strip-shaped, two ends of the rough surface respectively extend to two ends of the imitation filament, and the rough surface faces an outer side of the glass shell, the rough surface produces a continuous and uninterruptible luminescence effect, which is closer to the luminescence effect produced by the continuous and uninterruptible filament.

Figure 1:
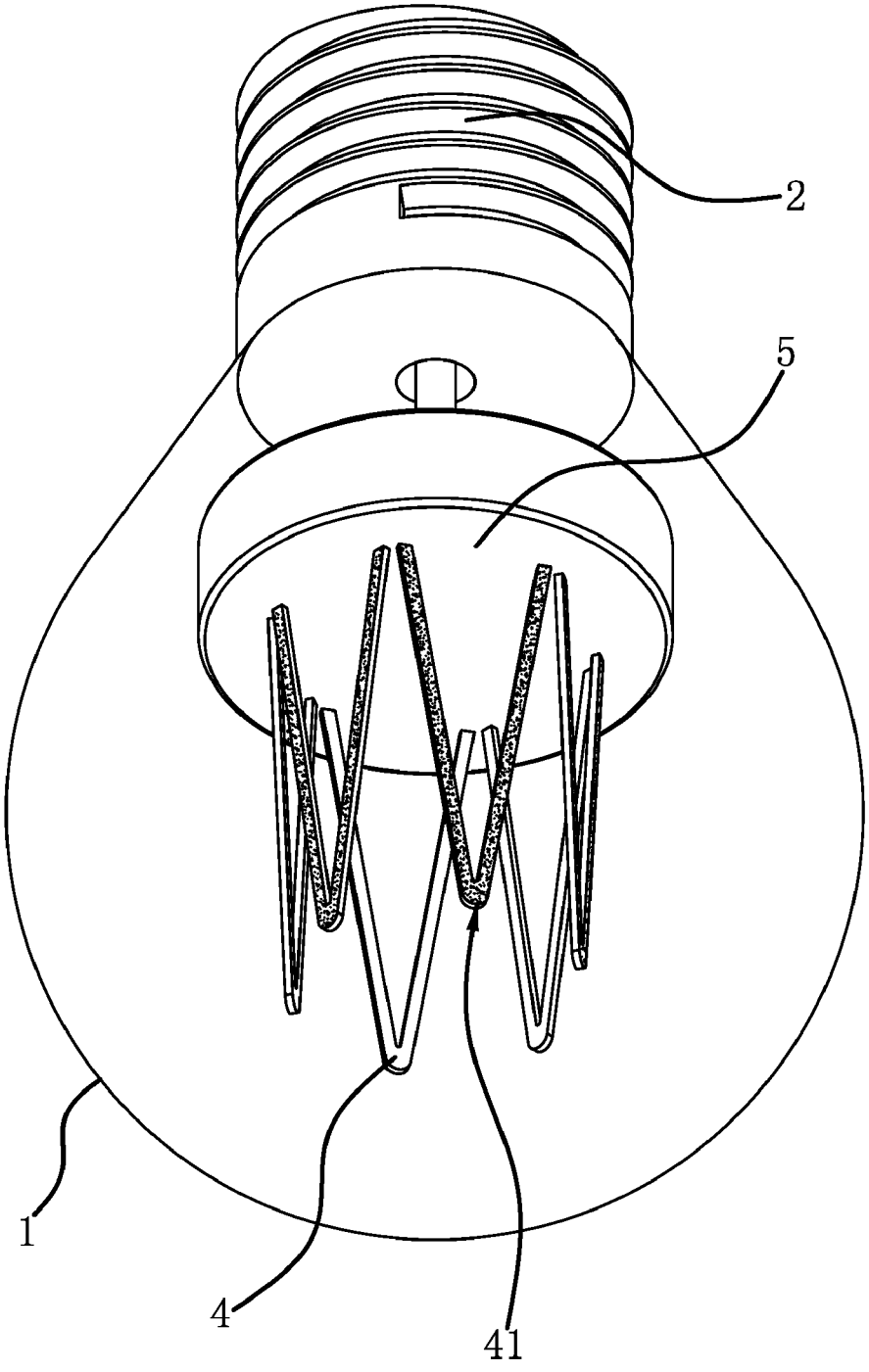
FIG. 1 is a schematic stereostructural diagram of an LED imitation filament bulb.

In the drawings, 1, glass shell; 2, lamp holder; 3, LED lamp bead; 4, imitation filament; 41, rough surface; 5, lampshade; 51, mounting cavity; 52, connection portion; and 6, lamp post.

DETAILED DESCRIPTION

Specific embodiments of the present invention are in the following, and technical solutions of the present invention are further described with reference to the drawings, but the present invention is not limited to these embodiments.

Figure 2:
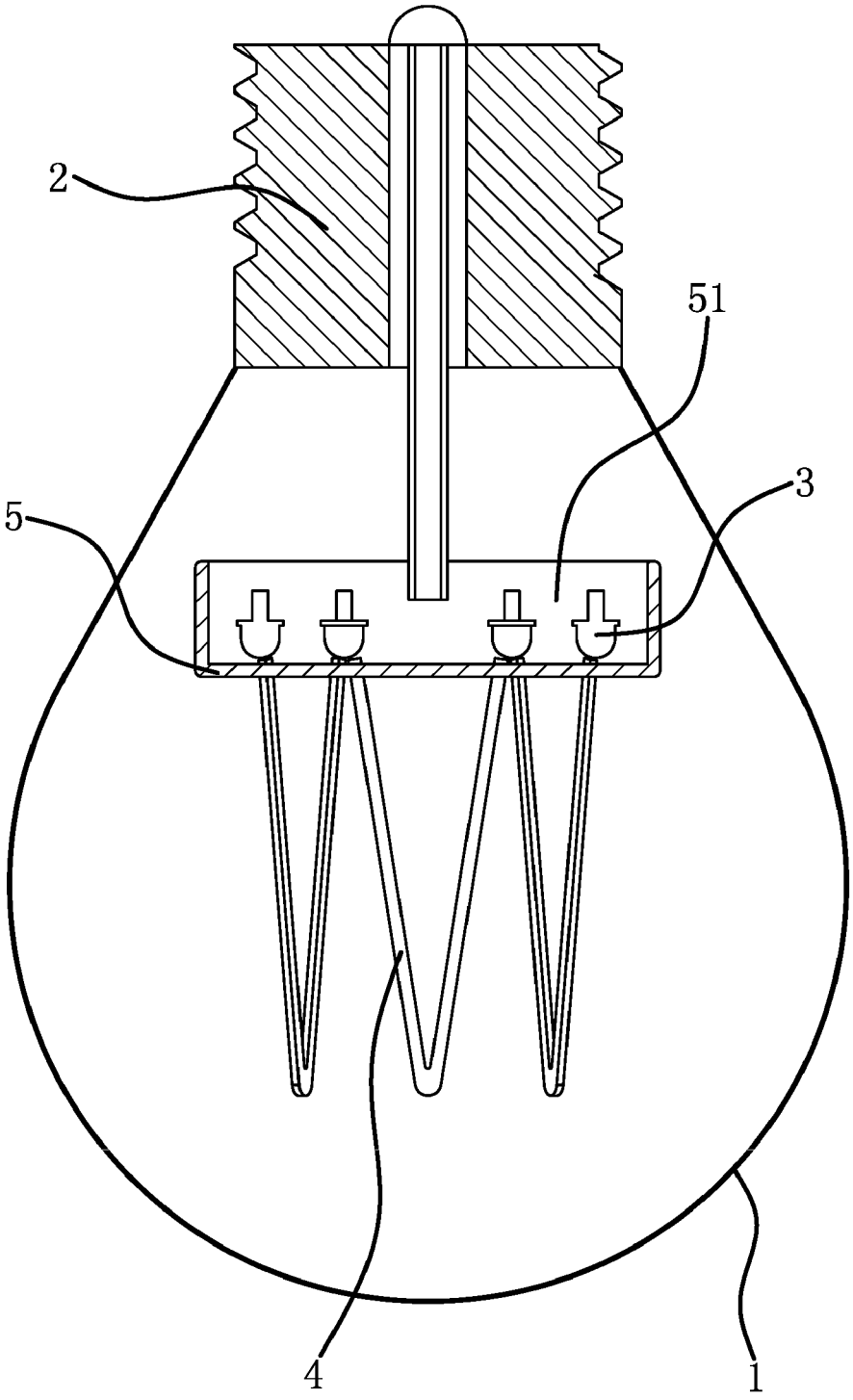
FIG. 2 is a structural section view of an LED imitation filament bulb.

Embodiment 1:

As shown in FIG. 1 and FIG. 2, an LED imitation filament bulb is disclosed and includes a glass shell 1, a lamp holder 2, and an LED lamp bead 3, where the lamp holder 2 is fixedly connected to the glass shell 1 and is used to be connected on the lamp base, and the lamp holder 2 and the lamp base implement electric connection; the LED lamp bead 3 is connected within the glass shell 1 and is electrically connected to the lamp holder 2; a imitation filament 4 is disposed within the glass shell 1; the imitation filament 4 is connected to the lamp holder 2; the imitation filament 4 is transparent; an outer side surface of the imitation filament 4 is provided with a rough surface 41; the imitation filament 4 is disposed in a bent manner; and a luminous surface of the LED lamp bead 3 faces an end surface of the imitation filament 4; as the name suggests, the imitation filament 4 imitates a filament shape of a traditional filament bulb, can be bent, spiral, and the like, and presents a bent state as a whole; the imitation filament 4 is provided with the rough surface 41; because the LED lamp bead 3 is opposite to the end surface of the imitation filament 4, light rays emitted by the LED lamp bead 3 can enter the imitation filament 4 and be transmitted within the imitation filament 4, so that the whole imitation filament 4 is filled with optical paths; when encountering the rough surface 41, the optical paths can be diffused, so that the whole rough surface 41 has a light strip effect, which is similar to an effect produced by the filament in the traditional filament bulb. Therefore, a bulb of the LED imitation filament 4 has a luminescence effect of a traditional filament bulb. However, because a light source uses the LED lamp bead 3, compared with a traditional filament bulb, the imitation filament bulb is more energy-saving and efficient.

Specifically, the rough surface 41 is strip-shaped and more has a lamp strip effect; two ends of the rough surface 41 respectively extend to two ends of the imitation filament 4, and the rough surface 41 faces an outer side of the glass shell 1, the rough surface 41 produces a continuous and uninterruptible luminescence effect, which is closer to the luminescence effect produced by the continuous and uninterruptible filament. The lampshade 5 is fixedly connected on the lamp holder 2; the lampshade 5 is used as a carrier of the LED lamp bead 3 and the imitation filament 4; the LED lamp bead 3 and the imitation filament 4 are both fixedly connected on the lampshade 5; the lampshade 5 is close to the lamp holder 2 and is located between the lamp holder 2 and the imitation filament 4, so that the imitation filament 4 is located at the middle position of the glass shell 1, which more accords with the position of a filament in a traditional filament bulb. In a traditional filament bulb that is used relatively widely, a filament is wave shaped and surrounds a circle. Therefore, in this embodiment, the imitation filaments 4 are six; each imitation filament 4 is bent and is V-shaped; two ends of each of the imitation filaments 4 are fixedly connected to the lampshade 5; and the six imitation filaments 4 are arranged circumferentially, and end portions of two adjacent imitation filaments 4 are close to each other, so that the several imitation filaments 4 have their heads and tails close to each other and present an effect of a wave shape surrounding a circle as a whole, and the effect is closer to the luminescence effect of the traditional filament bulb. The lampshade 5 is disciform; one side surface of the lampshade 5 is provided with a mounting cavity 51; the mounting cavity 51 faces the lamp holder 2; the LED lamp bead 3 is circumferentially connected within the mounting cavity 51; several groups of slots are provided circumferentially on an end surface of the lampshade 5; each group of slots has two slots close to one another; one end of either of two adjacent imitation filaments 4 is plugged and secured to slots within the same group and extends into the mounting cavity 51; the number of LED lamp beads 3 is the same as the number of the imitation filaments 4 that is, end surfaces of two imitation filaments 4 plugged into the same group of slots are opposite to the same LED lamp bead 3, so that several imitation filaments 4 have the same luminescence effect, and the number of the LED lamp beads 3 is reduced, making more energy-saving.

A processing mode of the imitation filament 4 uses a transparent plastic board, forms a imitation filament 4 by cutting the plastic board, the cut imitation filament 4 being flat, that is, the cross section of the imitation filament 4 being strip-shaped, and the rough surface 41 being one side surface of the imitation filament 4, and then produces a required shape of the imitation filament 4 by bending. Injection molding may also be performed directly by plastics according to a required shape of the imitation filament 4; the cross section of the imitation filament 4 subjected to injection molding is circular, and the rough surface is located on an outer periphery of the imitation filament 4, that is, processing such as grinding or scratching is performed on a side surface of the imitation filament 4 subjected to injection molding to produce the rough surface 41.

Figure 3:
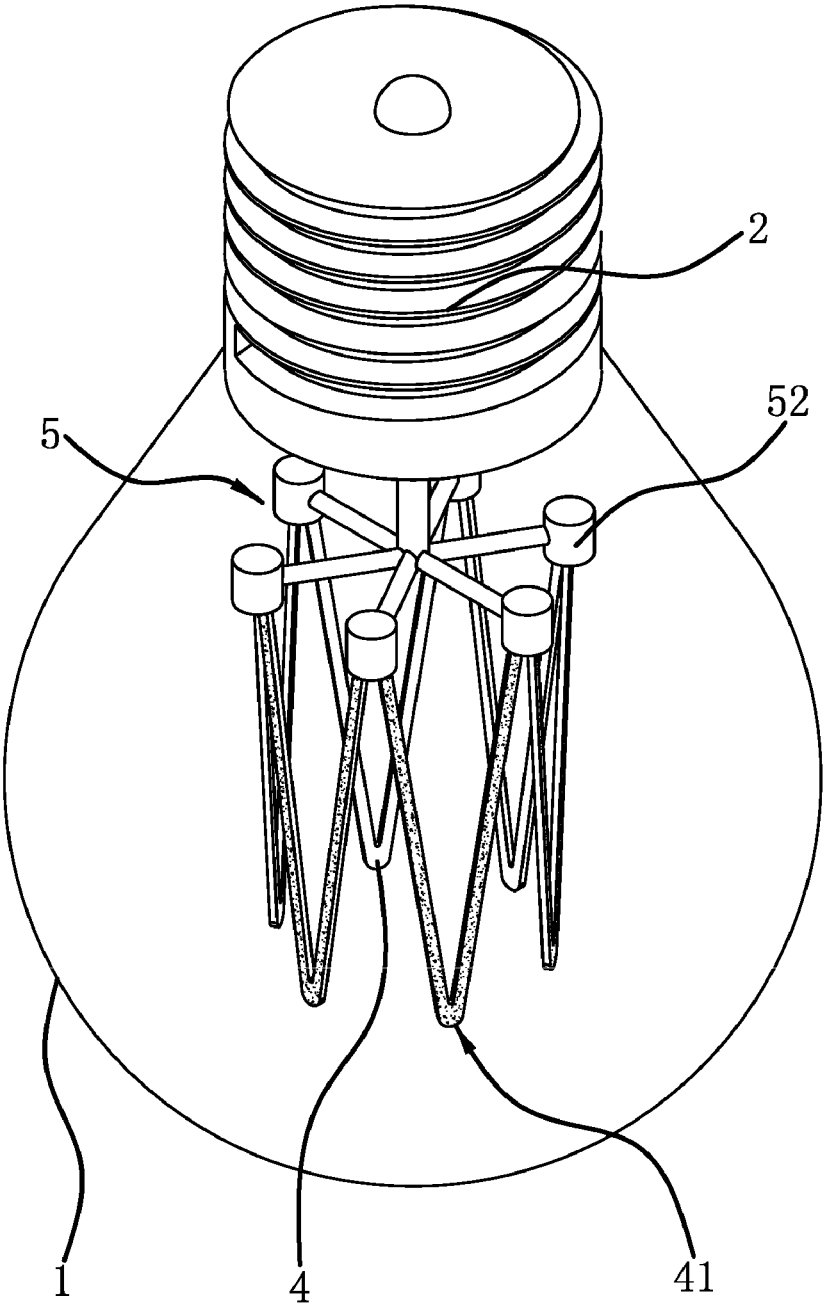
FIG. 3 is a schematic stereostructural diagram of an LED imitation filament bulb in Embodiment 2.
Figure 4:
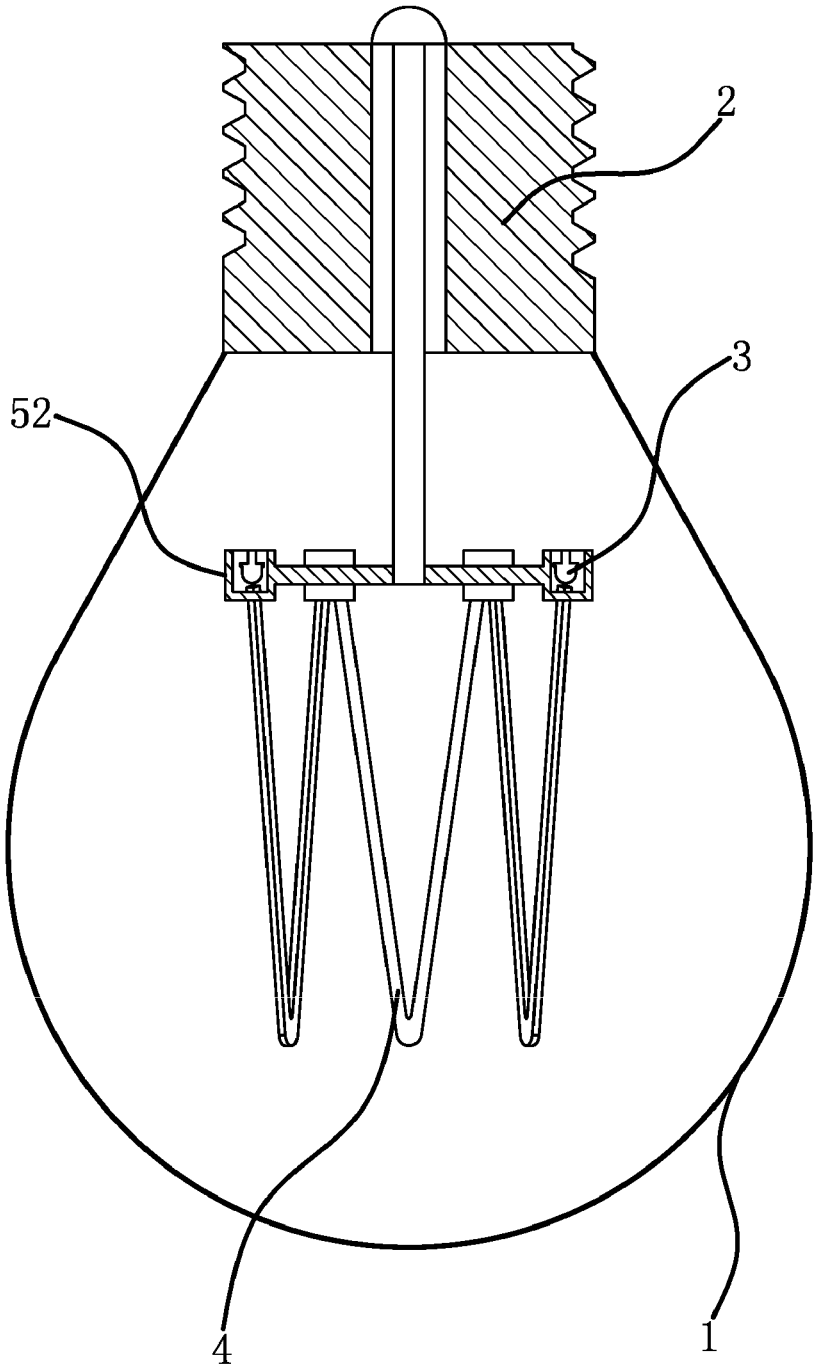
FIG. 4 is a structural section view of an LED imitation filament bulb in Embodiment 2.

Embodiment 2:

The structure of a bulb of the LED imitation filament 4 is basically the same as that in Embodiment 1, and differences are as shown in FIG. 3 and FIG. 4. The lampshade 5 is used to be connected to the imitation filament 4; therefore, a connection portion 52 used to mount the LED lamp beads 3 and be connected to the imitation filament 4 is provided, that is, the lampshade 5 has six connection portions 52 circumferentially and uniformly arranged; the number of the connection portions 52 is the same as the number of the LED lamp beads and the number of the imitation filaments 4; an LED lamp bead 3 is connected on each connection portion 52; two slots close to one another are also disposed on the connection portion 52; one end of either of two adjacent imitation filaments 4 is plugged into two slots of the same connection portion 52, and is opposite to the LED lamp beads 3 on the connection portion 52; a luminescence effect of the imitation filament 4 is close to the luminescence effect of the imitation filament 4 in Embodiment 1.

Figure 5:
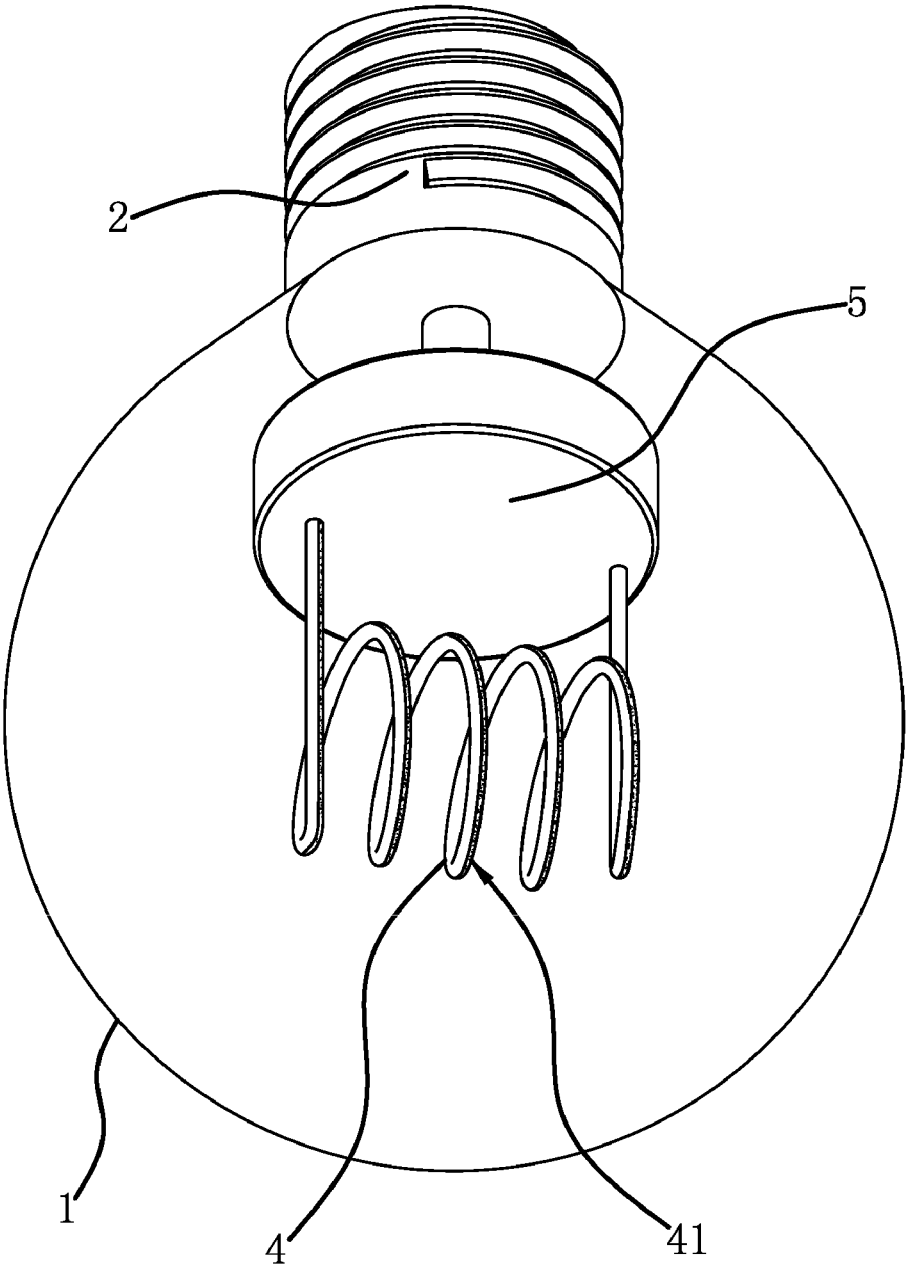
FIG. 5 is a schematic stereostructural diagram of an LED imitation filament bulb in Embodiment 3.
Figure 6:
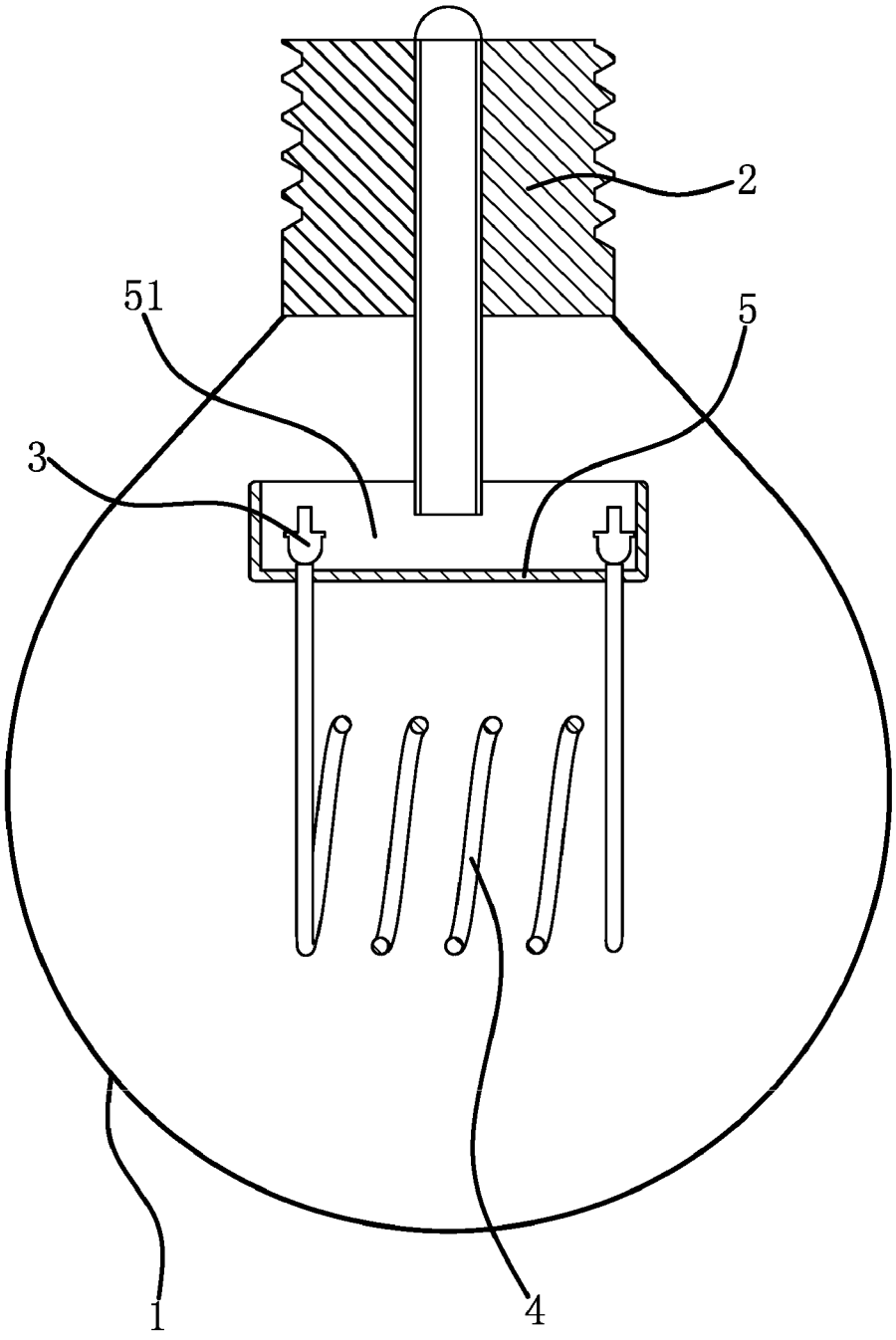
FIG. 6 is a structural section view of an LED imitation filament bulb in Embodiment 3.

Embodiment 3:

The structure of a bulb of the LED imitation filament 4 is basically the same as that in Embodiment 1, and differences are as shown in FIG. 5 and FIG. 6. the number of the imitation filaments 4 is one, and the imitation filament 4 is helical; two ends of the imitation filament 4 are both fixedly connected on the lampshade 5; the lampshade 5 is disciform; one side surface of the lampshade 5 is provided with a mounting cavity 51; the number of the LED lamp beads 3 is two, and the LED lamp beads 3 are fixedly connected within the mounting cavity 51; two end portions of the imitation filament 4 both extend into the mounting cavity 51, and two end surfaces of the imitation filament 4 are respectively opposite to the two LED lamp beads 3; the helical imitation filament 4 makes the rough surface 41 be helical, that is, a luminescence effect similar to a helical filament is produced.

Figure 7:
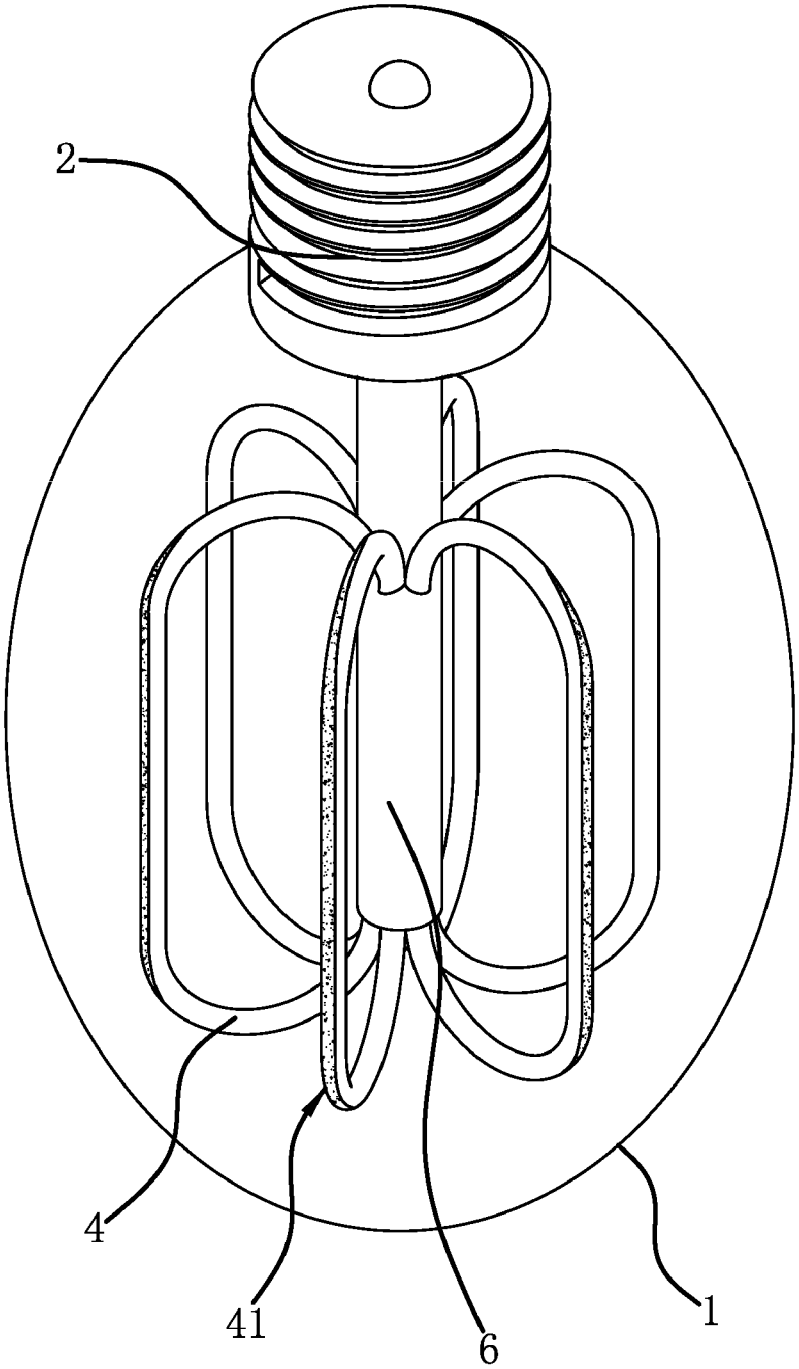
FIG. 7 is a schematic stereostructural diagram of an LED imitation filament bulb in Embodiment 4.
Figure 8:
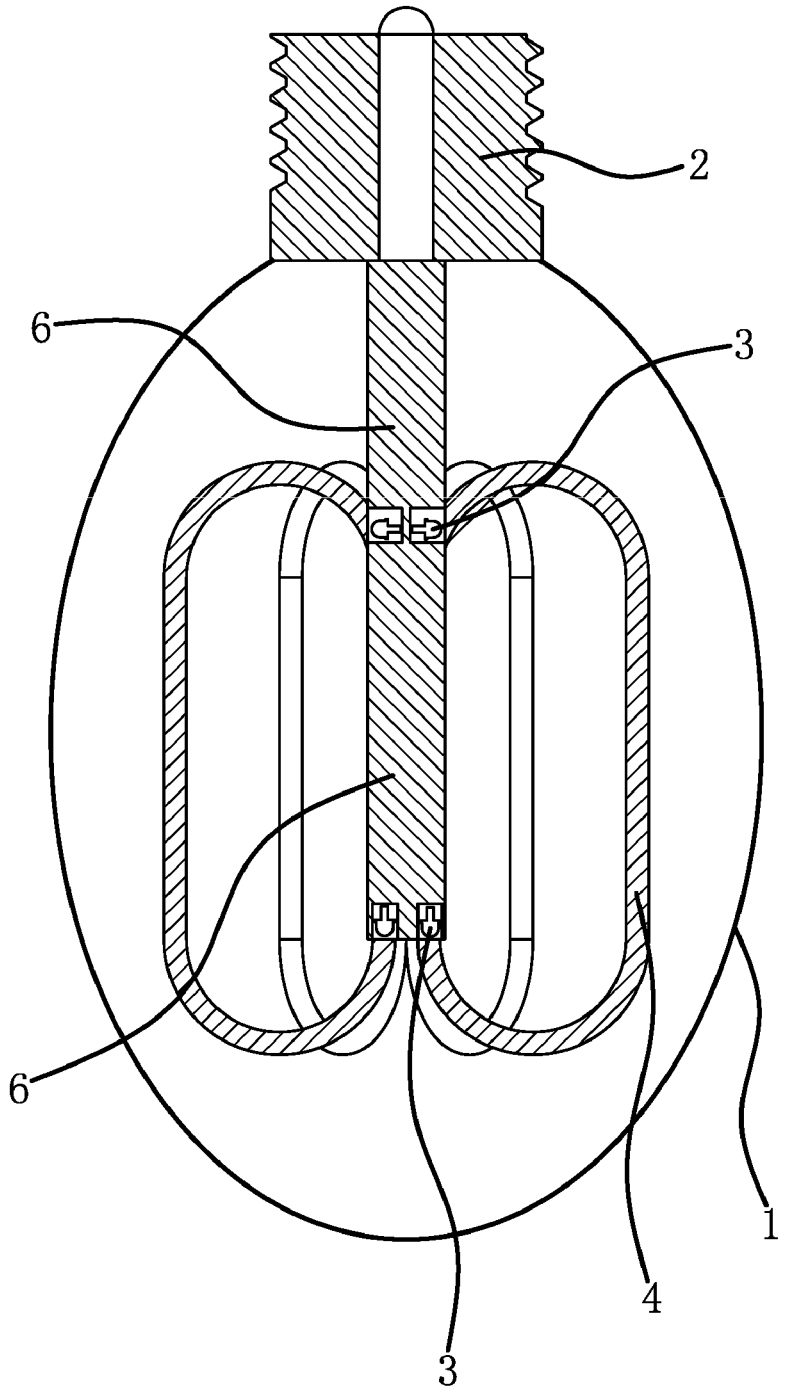
FIG. 8 is a structural section view of an LED imitation filament bulb in Embodiment 4.

Embodiment 4:

The structure of a bulb of the LED imitation filament 4 is basically the same as that in Embodiment 1, and differences are as shown in FIG. 7 and FIG. 8. A lamp post 6 is fixedly connected on the lamp holder 2; the lamp post 6 is used as a carrier of the LED lamp bead 3 and the imitation filament 4; the number of the imitation filaments 4 are six, and two ends of each of the six imitation filaments 4 are both bent in an arc shape and are fixedly connected to an outer side wall of the lamp post 6; the six imitation filaments 4 are circumferentially arranged; the LED lamp beads 3 are fixedly connected on the lamp post 6; and two end surfaces of each imitation filament 4 are both opposite to one LED lamp bead 3, so that the six imitation filaments 4 present a luminescence effect of a traditional filament bulb.

The specific embodiments described in this text only illustrate the spirit of the present invention. A person skilled in the art can make various modifications or supplements to the described specific embodiments or adopt similar manners to replace the described specific embodiments without departing from the spirit of the present invention or exceeding the scope defined by the claims.

Although terms such as a glass shell 1, a lamp holder 2, and an LED lamp bead 3 are frequently used in this text, but a possibility of using other terms is not excluded. These terms are used only to more facilitate description and explanation of the nature of the present invention; it is a violation to the spirit of the present invention to explain these terms as any additional limitation.

The invention claimed is:

1. An LED imitation filament bulb, comprising:

a glass shell, a lamp holder fixedly connected to the glass shell, and an LED lamp bead connected within the glass shell, where the LED lamp bead is electrically connected to the lamp holder;

at least one imitation filament connected to the lamp holder is disposed within the glass shell;

the imitation filament is transparent;

the imitation filament is disposed in a bent manner; and a luminous surface of the LED lamp bead faces an end surface of the imitation filament, wherein an outer side surface of the imitation filament is provided with at least one rough surface, the rough surface is strip shaped, and the rough surface faces an outer side of the glass shell, a lampshade is fixedly connected on the lamp holder, the LED lamp bead and the imitation filament are both fixedly connected on the lampshade, and the imitation filament is located at a middle portion of the glass shell, the imitation filaments are several, each of the imitation filaments is bent and is V-shaped, two ends of each of the imitation filaments are fixedly connected to the lampshade, and the several imitation filaments are arranged circumferentially, and the lampshade is disciform, one side surface of the lampshade is provided with a mounting cavity, the LED lamp bead is circumferentially connected within the mounting cavity, an end portion of the imitation filament extends into the mounting cavity, and end surfaces, close to each other, of two adjacent imitation filaments are opposite to the same LED lamp bead.

2. The LED imitation filament bulb of claim 1, wherein a lamp post is fixedly connected on the lamp holder;

the imitation filaments are several, and two ends of each of the several imitation filaments are both bent in an arc shape and are fixedly connected to an outer side wall of the lamp post;

the several imitation filaments are circumferentially arranged;

the LED lamp beads are several, and the LED lamp beads are fixedly connected on the lamp post; and one end surface of each imitation filament is opposite to one LED lamp bead, the lamp post is used as a carrier of the LED lamp bead and the imitation filament, and two end surfaces of the same imitation filament are both opposite to one LED lamp bead.

3. The LED imitation filament bulb of claim 1, wherein a cross section of the imitation filament is strip-shaped, and the rough surface is one side surface of the imitation filament.

4. The LED imitation filament bulb of claim 1, wherein a cross section of the imitation filament is circular, and the rough surface is located on an outer periphery of the imitation filament.

5. An LED imitation filament bulb, comprising:

a glass shell, a lamp holder fixedly connected to the glass shell, and a LED lamp bead connected within the glass shell, where the LED lamp bead is electrically connected to the lamp holder;

at least one imitation filament connected to the lamp holder is disposed within the glass shell;

the imitation filament is transparent;

the imitation filament is disposed in a bent manner; and a luminous surface of the LED lamp bead faces an end surface of the imitation filament, wherein an outer side surface of the imitation filament is provided with at least one rough surface, the rough surface is strip shaped, and the rough surface faces an outer side of the glass shell, a lampshade is fixedly connected on the lamp holder, the LED lamp bead and the imitation filament are both fixedly connected on the lampshade, and the imitation filament is located at a middle portion of the glass shell, the imitation filaments are several, each of the imitation filaments is bent and is V-shaped, two ends of each of the imitation filaments are fixedly connected to the lampshade, and the several imitation filaments are arranged circumferentially, and the lampshade is provided with several connection portions that are circumferentially uniformly arranged; an LED lamp bead is connected on each connection portion; the ends, close to each other, of two adjacent imitation filaments are both fixedly connected on the same connection portion, and the end surfaces are opposite to the LED lamp beads.

6. An LED imitation filament bulb, comprising:

a glass shell, a lamp holder fixedly connected to the glass shell, and a LED lamp bead connected within the glass shell, where the LED lamp bead is electrically connected to the lamp holder;

at least one imitation filament connected to the lamp holder is disposed within the glass shell;

the imitation filament is transparent;

the imitation filament is disposed in a bent manner; and a luminous surface of the LED lamp bead faces an end surface of the imitation filament, wherein an outer side surface of the imitation filament is provided with at least one rough surface, the rough surface is strip shaped, and the rough surface faces an outer side of the glass shell, a lampshade is fixedly connected on the lamp holder, the LED lamp bead and the imitation filament are both fixedly connected on the lampshade, and the imitation filament is located at a middle portion of the glass shell, wherein the number of the imitation filaments is one, and the imitation filament is helical, two ends of the imitation filament are both fixedly connected on the lampshade, the lampshade is disciform, one side surface of the lampshade is provided with a mounting cavity, the number of the LED lamp beads is two, and the LED lamp beads are fixedly connected within the mounting cavity, two end portions of the imitation filament both extend into the mounting cavity, and two end surfaces of the imitation filament are respectively opposite to the two LED lamp beads.

* * * * *